US006088845A

United States Patent [19]

Estrada

[11] Patent Number: 6,088,845

[45] Date of Patent: Jul. 18, 2000

[54] VENTILATED URINAL SYSTEM

[76] Inventor: Juan Jose Hugo Ceja Estrada, Aquiles Serdan 123 Sur, 80000, Culiacan, Sinaloa, Mexico

[21] Appl. No.: 08/970,875

[22] Filed: Nov. 14, 1997

Related U.S. Application Data

[62] Division of application No. 08/796,208, Feb. 7, 1997, which is a continuation of application No. 08/386,550, Feb. 10, 1995.

[51] Int. Cl.[7] ..... E03D 13/00

[52] U.S. Cl. ..... 4/306

[58] Field of Search ..... 4/306

[56] References Cited

U.S. PATENT DOCUMENTS

| | | | |
|---|---|---|---|
| 262,295 | 8/1882 | Hyde | 4/306 |
| 704,471 | 7/1902 | Brown | 4/306 X |
| 1,061,522 | 5/1913 | Bruder | 4/352 |
| 1,441,007 | 1/1923 | Littlefield . | |
| 2,452,282 | 10/1948 | Auer | 4/216 X |
| 2,619,655 | 12/1952 | Huff | 4/213 |
| 2,646,574 | 7/1953 | Gillespie . | |
| 3,064,274 | 11/1962 | Gleason | 4/216 |
| 3,273,170 | 9/1966 | Wheeler | 4/348 |
| 3,333,285 | 8/1967 | Null | 4/217 |
| 4,222,129 | 9/1980 | Baker | 4/216 X |
| 4,617,687 | 10/1986 | Wadsworth . | |
| 4,993,083 | 2/1991 | Lemieux | 4/216 X |
| 5,029,346 | 7/1991 | Fernald . | |
| 5,167,039 | 12/1992 | Sim | 4/216 |
| 5,259,072 | 11/1993 | Trombley . | |
| 5,305,973 | 4/1994 | Hakamura . | |
| 5,353,443 | 10/1994 | Sim . | |
| 5,369,812 | 12/1994 | Trombley . | |

FOREIGN PATENT DOCUMENTS

| | | | |
|---|---|---|---|
| 2943641 | 5/1980 | Germany | 4/348 |

*Primary Examiner*—Charles E. Phillips
*Attorney, Agent, or Firm*—Donald J. Lenkszus

[57] ABSTRACT

A urinal or toilet ventilation system for removing unpleasant odors from the vicinity of the urinal or toilet, both during usage and for a short period of time following usage. The ventilation system has a series of flexible water ducts extending throughout the device and leading to the outside. Additionally, the device has a series of air ducts extending throughout the device and attaching to a motor which in turns pushes the air through another series of ducts leading to the outside. In a further embodiment the urinal or toilet has a sensor to detect the presence of a user for actuating the motor and begins the air extraction system. Upon the user leaving the vicinity of the urinal or toilet, the sensor has a built in delay, and continues to extract any unpleasant odors for a short duration.

4 Claims, 3 Drawing Sheets

VENTILATED URINAL SYSTEM

This is a divisional of copending application, Ser. No. 08/796,208 filed on Feb. 7, 1997, which is a continuation of Ser. No. 08/386,550 filed on Feb. 10, 1995.

FIELD OF THE INVENTION

The present invention relates to a ventilating toilet and a ventilating urinal and ventilation systems for removing unpleasant odors from toilet or urinal.

BACKGROUND OF THE INVENTION

Toilets and urinals in the marketplace typically include a trap or similar attachment coupled to the soil or drain pipe which prevents the return of unpleasant odors from the sewers. Such attachments isolate unpleasant odors only after use of the toilet or urinal, but do nothing with respect to odors produced during use of the toilet or urinal.

Arrangements for removing unpleasant odors from the area of a toilet or urinal are known. For example, U.S. Pat. No. 5,305,473 to Nakamura discloses a urinal having a so-called smell release function. The Nakamura urinal shell has an air space formed within the urinal shell and "smell release ports" for drawing the offensive air generated in the urinal into the air space. The offensive smell is then vented from the vicinity of the urinal through a drain pipe. The Nakamura urinal does not have any means for sensing the presence of a person.

Other examples of toilets and urinals for exhausting unpleasant odors include: U.S. Pat. No. 2,646,574 to Gillespie which discloses a urinal with strategically placed vents; and U.S. Pat. No. 704,471 to Brown which discloses a ventilator attachment to toilets.

Each of the above described toilets and urinals has drawbacks. One major drawback of prior urinals is that they do not have a sensor for detecting the presence of a user of the urinal. Furthermore, the patents described above which disclose urinals that have an odor removing mechanisms, operate the mechanisms only at such time as the user has concluded use of the urinal.

In the case of a visit to the toilet or urinal which is long in duration and has created unpleasant odors in the process, a device which can remove the unpleasant odors during the visit is very desirable.

Therefore, it is desirable to provide a toilet or urinal system which will detect the presence of a user, and operate to exhaust unpleasant odors from the vicinity during use of the toilet or urinal and until such time as the user has concluded such use.

It is therefore one object of the present invention to provide toilet and urinal systems which effectively remove unpleasant odors from the vicinity of the toilet or urinal.

Additionally, it is a further object of the invention to provide a toilet and urinal for use in a system for removing unpleasant odors during use of the toilet or urinal.

It is yet a further object of the invention to provide a ventilation system for a toilet or urinal which will operate automatically during use of the toilet or urinal.

SUMMARY OF THE INVENTION

These and other objects of the invention are provided by toilets and urinals and ventilation systems assembled in accordance with the principles of the invention.

In accordance with the principles of the invention, the toilet and urinal apparatus removes unpleasant odors during use of the toilet or urinal. The toilet and urinal disclosed comprises an air exhaust system together with a sensor which becomes activated upon the presence of a user.

A toilet in accordance with the invention includes a water tank and a toilet bowl, the bowl having an integrally formed rim. The rim includes an integrally formed first duct in communication with the tank. The toilet includes first apertures extending through the wall of the bowl and in communication with the first duct. The rim further includes a second duct extending around at least a portion of the periphery of the toilet bowl. The rim has second apertures formed in the rim in communication with the second duct to provide a ventilation path to exhaust air and odors from the vicinity of the toilet bowl.

A urinal in accordance with the invention includes an integrally formed rim surrounding the urinal bowl and the urine collecting wall of the urinal. The rim includes an integrally formed duct second having apertures extending through the wall of the rim to provide a ventilation path to exhaust air and odors from the vicinity of the urinal through the apertures and the duct.

A ventilation system utilizing the ventilating toilet or ventilating urinal includes an exhaust fan coupled to the second duct. The exhaust fan is coupled to a pipe to exhaust air outside the vicinity of the toilet or urinal. A sensor amounted adjacent to toilet or urinal is used to sense the presence of a user. The sensor acts as a switch to turn the exhaust fan on. The fan will remain on until the user leaves the vicinity of the toilet or urinal and then after a predetermined time turns the exhaust fan off.

BRIEF DESCRIPTION OF THE DRAWINGS

The invention will be better understood from a reading of the following detailed description of illustrative embodiments of the invention in which like reference designations identify like elements and in which.

DETAILED DESCRIPTION OF THE PREFERRED EMBODIMENTS

Toilets and urinals to date have introduced methods relating to the release of unpleasant odors created during the use of the device. Some devices provide ventilation systems which activate upon the end of the users visit. However, none of the toilets or urinal devices to date solve the problem encountered with releasing unpleasant odors during actual use of the device.

Figure 2:
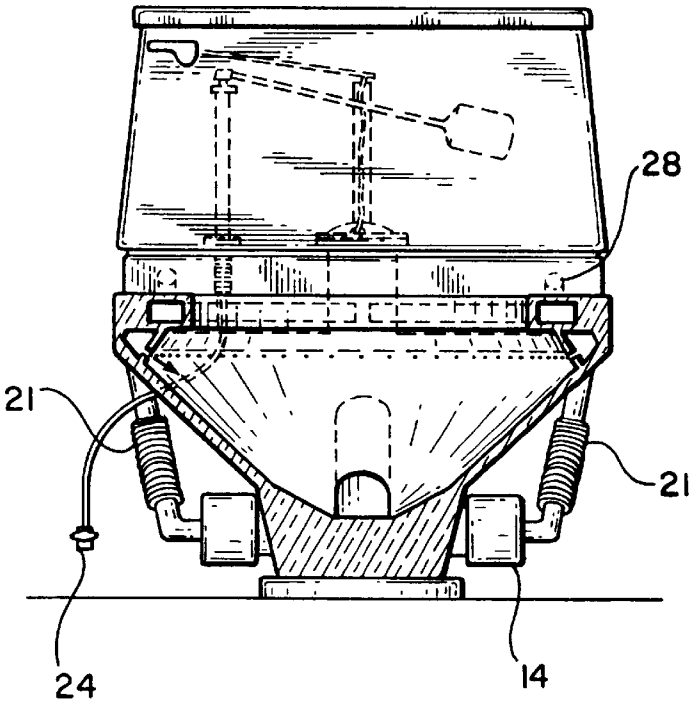
FIG. 2 is a frontal view of the toilet ventilation system of FIG. 1.
Figure 1:
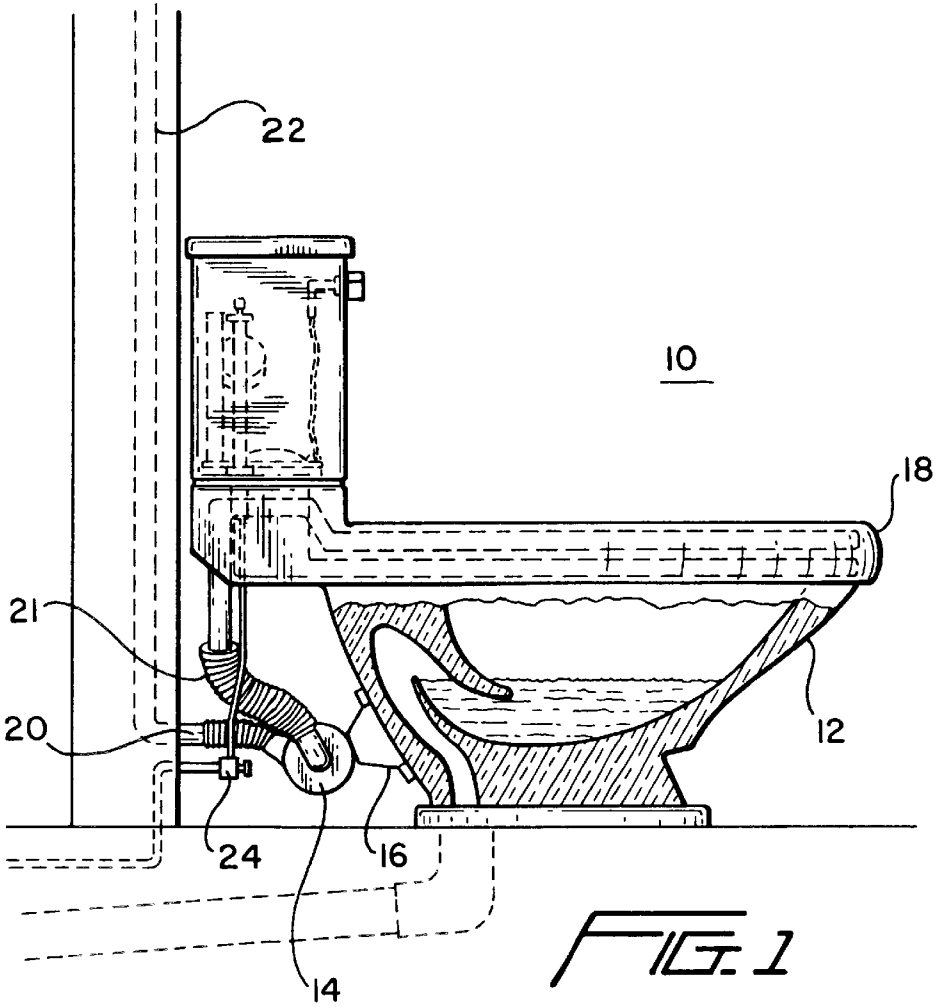
FIG. 1 is a partial cross sectional view of one embodiment of a toilet ventilation system.

FIG. 1 illustrates the novel toilet 10 and the novel ventilation system of the invention. The toilet 10 includes a bowl 12 positioned on floor 1 adjacent wall 3. A soil or drain pipe 2 is positioned under toilet 10. An exhaust pipe 22 is supported within wall 3. Toilet 10 includes a bowl 12 and a tank 13. The upper portion of the bowl 12 has an integrally formed rim 18. The toilet 10 also includes an integrally formed rear portion which supports the tank 13. Although it is not shown in the drawings, a toilet seat is hinged to the bowl 12 and in one position rests on rim 18. Toilet bowl 12 includes an integrally formed trap 12*a*. Toilet 10 is positioned on floor 1 so that the soil pipe 2 is under trap 12*a*. Trap 12*a* holds a quantity of water to prevent venting of sewer gas from the soil pipe 12 into the restroom. A valve 24 mounted on wall 3 and connected to water line 4 provides flush water to the toilet.

As more clearly seen in FIGS. 2, 3, 4, and 5, rim 18 includes a first water duct 27 which surrounds the bowl 12. The water duct is coupled via integrally formed passage 27B to the tank 13. The duct 27 has evenly spaced apertures 27A to provide flush water to the toilet. When toilet lever 7 is operated, flapper valve 8 opens allowing water to flow through passage 27B, through water duct 27 and out apertures 27A to flush the toilet while simultaneously rinsing the wall of the toilet bowl.

Positioned in rim 18 above the water duct 27 are second and third integrally formed air ducts 26A and 26B. Each air duct 26A, 26B extends around approximately one-half of the periphery of rim 18. Each duct 26A, 26B includes apertures 29A spaced apart uniformly and extending through the wall of the rim 18.

Duct 26A has a passageway integrally formed in the toilet which includes a duct portion which forms an inverted siphon trap that terminated in an outlet 22A.

Similarly duct 26B includes an integral passageway including a duct portion 28B which forms an inverted siphon or trap terminating in outlet 22B. The duct portions 28A and 28B are positioned higher than the duct portions 26A and 26B respectively to help prevent the suction of moisture from the toilet bowl. The integrally formed outlets 22A and 22B are each connected to an exhaust fan.

Outlet 22A is connected to exhaust fan 14A via flexible pipe 21A. The outlet of fan 14A is in turn connected to exhaust pipe 22 via flexible pipe 20A. Similarly outlet 22B is connected to exhaust fan 14B via flexible pipe 21B and the outlet of exhaust fan 14B is coupled to exhaust pipe 22 by flexible pipe 20B.

The exhaust fans 14A and 14B are positioned adjacent the lower portion of the toilet and held by means of a metal bracket 16 which in attached to the rear of the toilet bowl 12.

The ventilation system includes a sensor 70 (FIG. 1) positioned on a section of the adjacent wall 3 above the toilet 10. The sensor 70 is coupled to exhaust fans 14A, 14B, and acts as a switch for activating the air extraction feature of the system when the toilet is in use. The sensor 70 is programmed such that the air extraction system continues to work for a predetermined time duration after a person leaves the toilet. This time delayed shut off of the exhaust fans 14A, 14B removes all of the unpleasant air from the vicinity of the toilet.

Figure 6:
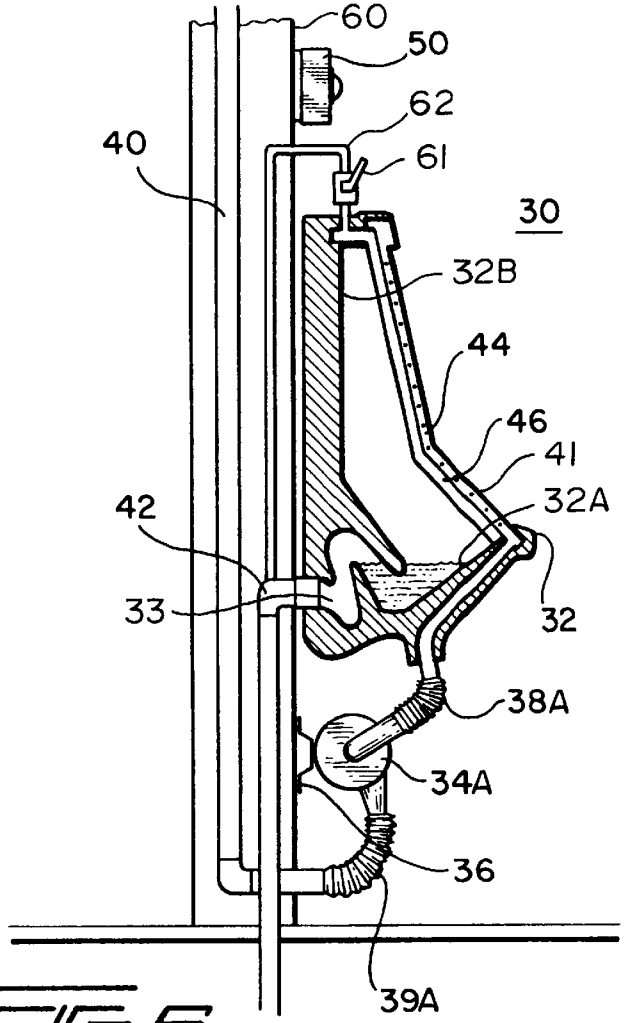
FIG. 6 illustrates a urinal ventilation system in which the urinal shown is cross sectional.
Figure 3:
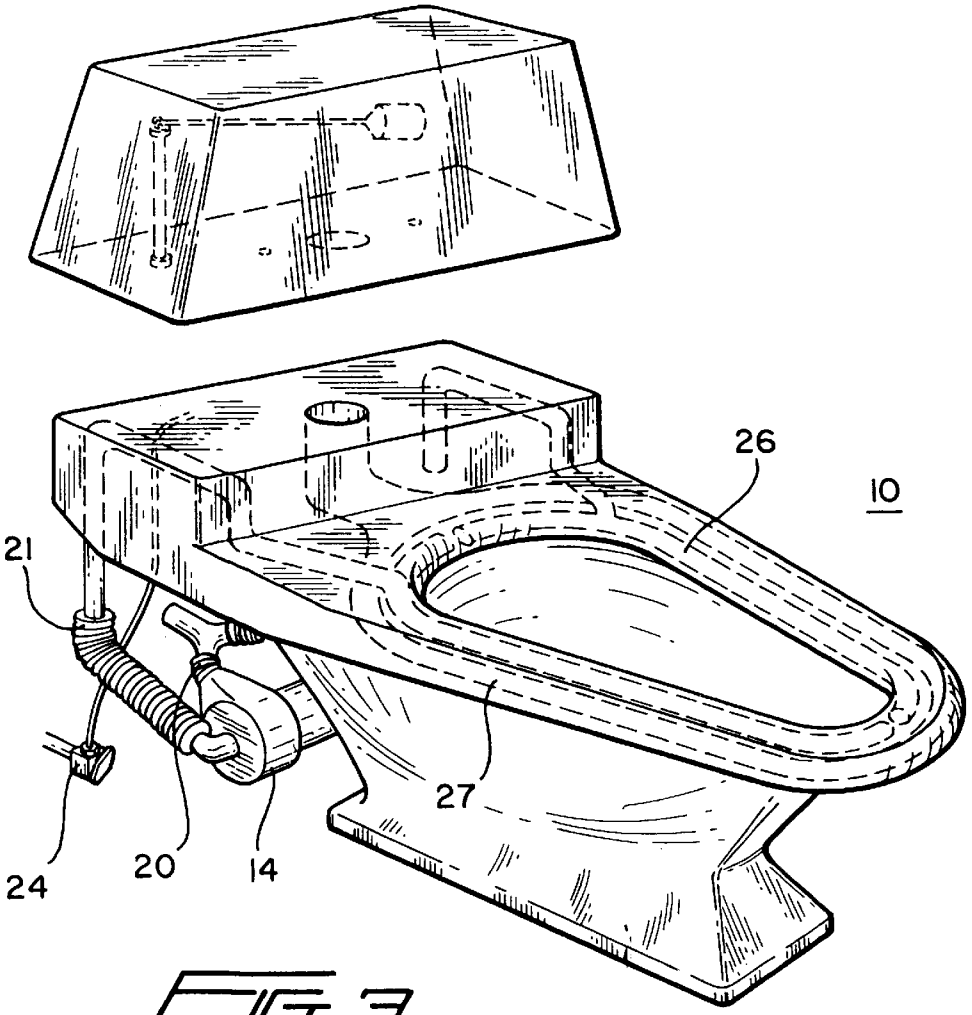
FIG. 3 is a partly exploded perspective view of the system of FIGS. 1 and 2 illustrating the air ducts and water ducts within the toilet.
Figure 4:
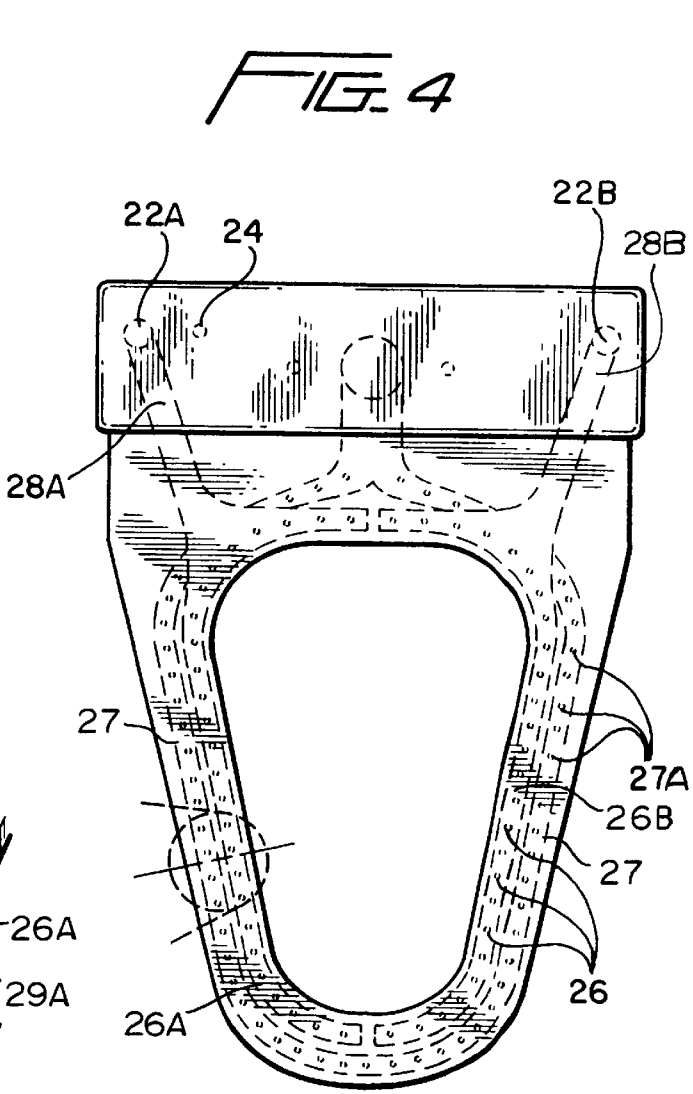
FIG. 4 is a top view of the toilet of FIGS. 1–3.
Figure 8:
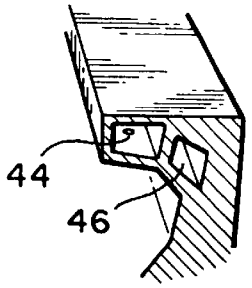
FIG. 8 shows a detailed cross sectional view of the air and water ducts of the urinal of FIG. 7.
Figure 5:
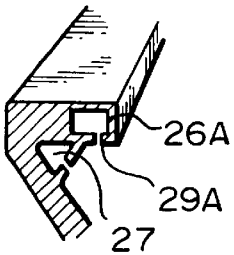
FIG. 5 shows a detailed cross sectional view of the air and water ducts of FIG. 4.
Figure 7:
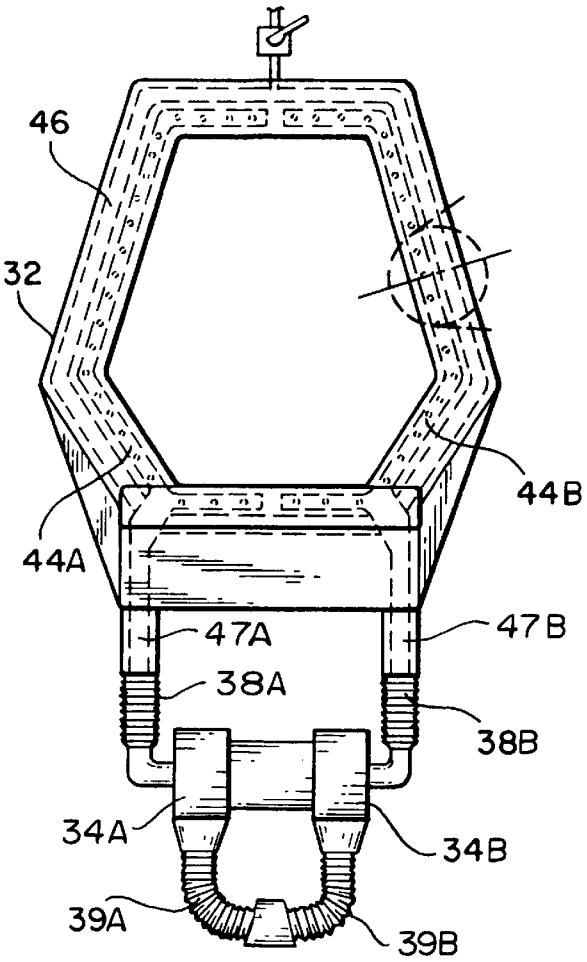
FIG. 7 is a front view of the urinal device of FIG. 6.

FIGS. 6, 7, and 8 illustrates a urinal 32 in accordance with the invention and a urinal ventilation system 30. The urinal system 30 includes exhaust fans 34A and 34B each fixed to an adjacent wall 60 by means of a metallic base 36. The urinal unit 32 is connected to a flush valve 61 which is connected to a water line 62. The urinal 32 includes an integrally formed trap 33 which is connected to a soil or drain pipe 42. Urinal 32 has a bowl portion 32A which receives the urine and a wall portion 32B. Around the urinal opening is an integrally formed rim 41.

As with the toilet ventilation system, the urinal unit 32 has air ducts for exhausting odors and a water duct system for flushing.

Rim 41 includes a first duct 46 which is coupled to the flush valve 61. The duct 46 includes apertures, which are not shown, spaced uniformly along its length. When flush valve 61 is operated water flows through duct 46 and along the walls of urinal 32 to flush the bowl and wash the walls of urinal 32. Also disposed in rim 41 are second and third ducts 44A and 44B which are ventilation or air ducts. The ducts 44A and 44B each include apertures 44 extending through the rim and spaced apart uniformly. The air ducts 44A and 44B each terminate in exhaust port portions 47A and 47B, respectively. Flexible pipe 38A and 38B, respectively, couple ducts 44A and 44B to exhaust fans 34A and 34B. The exhaust outlets of fans 34A and 34B are coupled via flexible pipes 39A and 39B, respectively, to exhaust pipe 40. Air ducts 44A and 44B enable the motor to extract the unpleasant odors from an area close to the source before any smells permeate the area surrounding the urinal.

The pipes 38A and 38B connected to the urinal unit 32 and the exhaust fans 34A and 34B are made of a flexible plastic material. The pipes 39A, 39B connecting the exhaust fans 34A, 34B to the air duct pipe 40 are also of a flexible plastic material. The flexibility allows for the ability to replace the exhaust fans 34A, 34B and the pipes with greater ease, and also permits easy installation of a larger or smaller size motor depending upon what is desired.

The pipe 40 exhausts air from the vicinity of the urinal to an outside area.

A sensor 50 is positioned on a section of the adjacent wall 60 above the urinal unit 32. The sensor 50 acts as a switch for activating the air extraction feature of the unit when the urinal is in use by operating the exhaust fans 34A and 34B when a person is in the vicinity of the urinal 34. The sensor 50 is programmed such that the air extraction system continues to exhaust air for a short duration after the person leaving the vicinity of the urinal 34 to remove all of the unpleasant air from the vicinity.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. A ventilating urinal comprising:

a bowl for collecting urine;

a urine catching wall integrally formed with said bowl and extending upwardly from said bowl, said bowl and said wall defining an opening for receiving urine;

an integrally formed rim disposed above and around the periphery of said bowl and around said wall;

at first integrally formed duct disposed in said rim and extending around said wall and said bowl, said duct being in fluid communication with a source of flush water;

a plurality of first apertures extending through said rim and in communication with said first duct, said first duct and said plurality of first apertures communicating water to said bowl and said wall during flushing of said urinal;

a second duct integrally formed in said rim, said second duct extending around at least a portion of said rim adjacent said bowl and at least a portion of said wall;

a plurality of second apertures formed in said rim, said second apertures each being in communication with said second duct to provide a ventilation path to exhaust air and odors from the area of said urinal;

a third duct integrally formed in said rim and extending around at least a second portion of said rim adjacent said bowl and at least a portion adjacent said wall;

a plurality of third apertures extending through said rim and in communication with said third duct to provide a second ventilation path to exhaust air and odors from the area of said urinal; and said second and said third ducts each terminating in a corresponding exhaust port, each said exhaust port coupleable to one or more exhaust fans.

2. A ventilating urinal in accordance with claim 1, wherein:

said rim portion and said second rim portion are on opposite sides of said rim.

3. A ventilation urinal in accordance with claim 1, comprising:

a first exhaust fan coupled to said second duct exhaust port; and a second exhaust fan coupled to said third duct exhaust port.

4. A ventilating urinal in accordance with claim 3, comprising:

a sensor mounted in the vicinity of said urinal, said sensor coupled to said first and second exhaust fans and operable to sense the presence of a person proximate said urinal to activate said first and second exhaust fans.

* * * * *